US006545647B1

(12) United States Patent
Sievenpiper et al.

(10) Patent No.: US 6,545,647 B1
(45) Date of Patent: Apr. 8, 2003

(54) ANTENNA SYSTEM FOR COMMUNICATING SIMULTANEOUSLY WITH A SATELLITE AND A TERRESTRIAL SYSTEM

(75) Inventors: Daniel F. Sievenpiper, Los Angeles, CA (US); Hui-Pin Hsu, Northridge, CA (US); James H. Schaffner, Chatsworth, CA (US); Gregory L. Tangonan, Oxnard, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 09/905,795

(22) Filed: Jul. 13, 2001

(51) Int. Cl.[7] ..... H01Q 9/16; H01Q 15/02

(52) U.S. Cl. ..... 343/795; 343/756; 343/795; 343/909

(58) Field of Search ..... 343/909, 795, 343/797, 824, 756, 700 MS, 793

(56) References Cited

U.S. PATENT DOCUMENTS

| | | | | |
|---|---|---|---|---|
| 3,267,480 A | | 8/1966 | Lerner | 343/911 |
| 3,810,183 A | | 5/1974 | Krutsinger et al. | 343/708 |
| 3,961,333 A | | 6/1976 | Purinton | 343/872 |
| 4,150,382 A | | 4/1979 | King | 343/754 |
| 4,266,203 A | | 5/1981 | Saundreau et al. | 333/21 |
| 4,308,541 A | * | 12/1981 | Seidel et al. | 343/786 |
| 4,387,377 A | | 6/1983 | Kandler | 343/756 |
| 4,594,595 A | | 6/1986 | Struckman | 343/770 |
| 4,737,795 A | | 4/1988 | Nagy et al. | 343/712 |
| 4,749,996 A | | 6/1988 | Tresselt | 343/700 |
| 4,760,402 A | | 7/1988 | Mizuno et al. | 343/713 |
| 4,782,346 A | | 11/1988 | Sharma | 343/795 |
| 4,821,040 A | | 4/1989 | Johnson et al. | 343/700 MS |
| 4,835,541 A | | 5/1989 | Johnson et al. | 343/713 |
| 4,843,400 A | | 6/1989 | Tsao et al. | 343/700 |
| 4,843,403 A | | 6/1989 | Lalezari et al. | 343/767 |
| 4,853,704 A | | 8/1989 | Diaz et al. | 343/767 |
| 4,905,014 A | | 2/1990 | Gonzalez et al. | 343/909 |
| 5,021,795 A | | 6/1991 | Masiulis | 343/700 |

(List continued on next page.)

FOREIGN PATENT DOCUMENTS

| | | | |
|---|---|---|---|
| DE | 196 00 609 A1 | 4/1997 | H01P/1/165 |
| EP | 0 539 297 | 4/1993 | H01Q/17/00 |
| FR | 2 785 476 | 5/2000 | H04B/7/02 |

(List continued on next page.)

OTHER PUBLICATIONS

Balanis, C., "Aperture Antennas," *Antenna Theory, Analysis and Design,* 2nd edition, John Wiley & Sons, New York, Chap. 12, pp. 575–597 (1997).

(List continued on next page.)

*Primary Examiner*—Hoang Nguyen
(74) *Attorney, Agent, or Firm*—Ladas & Parry

(57) ABSTRACT

An antenna system for receiving both circularly polarized electromagnetic signals and linearly polarized electromagnetic signals, the circularly polarize signals arriving at the antenna system from a direction normal or oblique to a major surface of the antenna system and the linearly polarized signals arriving at the planar antenna system from a direction acute to said major surface. The antenna system includes a high impedance surface and a plurality of antenna elements disposed on said high impedance surface, the plurality antenna elements arranged in a pattern on said surface such first selected ones of said antenna elements are responsive to circular polarization and second selected ones of said antenna elements are responsive to linear polarization.

37 Claims, 7 Drawing Sheets

U.S. PATENT DOCUMENTS

| | | | | | |
|---|---|---|---|---|---|
| 5,023,623 | A | | 6/1991 | Kreinheder et al. | 343/725 |
| 5,081,466 | A | | 1/1992 | Bitter, Jr. | 343/767 |
| 5,115,217 | A | | 5/1992 | McGrath et al. | 333/246 |
| 5,146,235 | A | | 9/1992 | Frese | 343/895 |
| 5,158,611 | A | | 10/1992 | Ura et al. | 106/499 |
| 5,177,493 | A | | 1/1993 | Kawamura | 343/713 |
| 5,208,603 | A | | 5/1993 | Yee | 343/909 |
| 5,268,701 | A | | 12/1993 | Smith | 343/767 |
| 5,287,118 | A | | 2/1994 | Budd | 343/909 |
| 5,402,134 | A | | 3/1995 | Miller et al. | 343/742 |
| 5,519,408 | A | | 5/1996 | Schnetzer | 343/767 |
| 5,525,954 | A | | 6/1996 | Komazaki et al. | 333/219 |
| 5,531,018 | A | | 7/1996 | Saia et al. | 29/622 |
| 5,532,709 | A | | 7/1996 | Talty | 343/819 |
| 5,534,877 | A | | 7/1996 | Sorbello et al. | 343/700 |
| 5,541,614 | A | | 7/1996 | Lam et al. | 343/792.5 |
| 5,557,291 | A | | 9/1996 | Chu et al. | 343/725 |
| 5,589,845 | A | | 12/1996 | Yandrofski et al. | 343/909 |
| 5,611,940 | A | | 3/1997 | Zettler | 73/514 |
| 5,638,946 | A | | 6/1997 | Zavracky | 200/181 |
| 5,682,168 | A | | 10/1997 | James et al. | 343/713 |
| 5,694,134 | A | | 12/1997 | Barnes | 343/700 |
| 5,721,194 | A | | 2/1998 | Yandrofski et al. | 505/210 |
| 5,818,394 | A | | 10/1998 | Aminzadeh et al. | 343/713 |
| 5,850,198 | A | | 12/1998 | Lindenmeier et al. | 343/713 |
| 5,874,915 | A | | 2/1999 | Lee et al. | 342/375 |
| 5,892,485 | A | * | 4/1999 | Glabe et al. | 343/789 |
| 5,894,288 | A | | 4/1999 | Lee et al. | 343/770 |
| 5,917,458 | A | | 6/1999 | Ho et al. | 343/909 |
| 5,923,303 | A | | 7/1999 | Schwengler et al. | 343/853 |
| 5,929,819 | A | | 7/1999 | Grinberg | 343/754 |
| 5,945,951 | A | | 8/1999 | Monte et al. | 343/700 |
| 5,949,382 | A | | 9/1999 | Quan | 343/767 |
| 6,005,519 | A | | 12/1999 | Burns | 343/700 |
| 6,005,521 | A | | 12/1999 | Suguro et al. | 343/700 MS |
| 6,037,912 | A | | 3/2000 | DeMarre | 343/815 |
| 6,040,803 | A | | 3/2000 | Spall | 343/700 |
| 6,046,655 | A | * | 4/2000 | Cipolla | 343/756 |
| 6,054,659 | A | | 4/2000 | Lee et al. | 200/181 |
| 6,075,485 | A | | 6/2000 | Lilly et al. | 343/700 |
| 6,081,235 | A | | 6/2000 | Romanofsky et al. | 343/700 |
| 6,081,239 | A | | 6/2000 | Sabet et al. | 343/753 |
| 6,091,367 | A | | 7/2000 | Kabashima et al. | 343/700 MS |
| 6,097,263 | A | | 8/2000 | Mueller et al. | 333/17.1 |
| 6,097,343 | A | | 8/2000 | Goetz et al. | 343/708 |
| 6,118,406 | A | | 9/2000 | Josypenko | 343/700 |
| 6,118,410 | A | | 9/2000 | Nagy | 343/713 |
| 6,127,908 | A | | 10/2000 | Bozler et al. | 333/246 |
| 6,154,176 | A | | 11/2000 | Fathy et al. | 343/700 |
| 6,166,705 | A | | 12/2000 | Mast et al. | 343/853 |
| 6,175,337 | B1 | | 1/2001 | Jasper, Jr. et al. | 343/770 |
| 6,191,724 | B1 | | 2/2001 | McEwan | 342/21 |
| 6,208,316 | B1 | | 3/2001 | Cahill | 343/909 |
| 6,218,978 | B1 | | 4/2001 | Simpkin et al. | 342/5 |
| 6,246,377 | B1 | | 6/2001 | Aiello et al. | 343/770 |
| 6,323,826 | B1 | * | 11/2001 | Sievenpiper et al. | 343/909 |
| 6,384,797 | B1 | * | 5/2002 | Schaffner et al. | 343/795 |

FOREIGN PATENT DOCUMENTS

| | | | |
|---|---|---|---|
| GB | 2 281 662 | 3/1995 | H01Q/13/08 |
| GB | 2 328 748 | 3/1999 | G01S/13/93 |
| WO | 94/00891 | 1/1994 | H01Q/15/00 |
| WO | 96/29621 | 9/1996 | G02B/5/20 |
| WO | 98/21734 | 5/1998 | H01H/59/00 |
| WO | 99/50929 | 10/1999 | H01Q/1/38 |
| WO | 00/44012 | 7/2000 | H01H/1/00 |

OTHER PUBLICATIONS

Balanis, C., "Microstrip Antennas," *Antenna Theory, Analysis and Design,* 2nd edition, John Wiley & Sons, New York, Chap. 14, pp. 722–736 (1997).

Perini, P. and C. Holloway, "Angle and Space Diversity Comparisons in Different Mobile Radio Environments," *IEEE Transactions on Antennas and Propagation,* vol. 46, No. 6, pp. 764–775 (Jun. 1998).

Vaughan, R., "Spaced Directive Antennas for Mobile Communications by the Fourier Transform Method," *IEEE Transactions on Antennas and Propagation,* vol. 48, No. 7, pp. 1025–1032 (Jul. 2000).

Bradley, T.W., et al., "Development of a Voltage–Variable Dielectric (VVD), Electronic Scan Antenna," *Radar 97,* Publication No. 449, pp. 383–385 (Oct. 1997).

Cognard, J., "Alignment of Nematic Liquid Crystals and Their Mixtures," *Mol. Crsyt. Liq, Cryst.,* Suppl. 1, 1 (1982) pp. 1–74.

Doane, J.W., et al., "Field Controlled Light Scattering from Nematic Microdroplets," *Appl. Phys. Lett.,* vol. 48, pp. 269–271 (Jan. 1986).

Ellis, T.J. and G.M. Rebeiz, "MM–Wave Tapered Slot Antennas on Micromachined Photonic Bandgap Dielectrics," *1996 IEEE MTT–S International Microwave Symposium Digest,* vol. 2, pp. 1157–1160 (1996).

Jensen, M.A., et al., "EM Interaction of Handset Antennas and a Human in Personal Communications," *Proceedings of the IEEE,* vol. 83, No. 1, pp. 7–17 (Jan. 1995).

Jensen, M.A., et al., "Performance Analysis of Antennas for Hand–held Transceivers using FDTD," *IEEE Transactions on Antenna and Propagation,* vol. 42, No. 8, pp. 1106–1113 (Aug. 1994).

Linardou, I., et al., "Twin Vivaldi antenna fed by coplanar waveguide," *Electronics Letters,* vol. 33, No. 22, pp. 1835–1837 (Oct. 23, 1997).

Ramo, S., et al., *Fields and Waves in Communication Electronics,* 3rd edition (New York, John Wiley & Sons, 1994) Section 9.8–9.11, pp. 476–487.

Schaffner, J.H., et al., "Reconfigurable Aperture Antennas Using RF MEMS Switches for Multi–Octave Tunability and Beam Steering," *IEEE,* pp. 321–324 (2000).

Sievenpiper, D., et al., "Low–profile, four–sector diversity antenna on high–impedance ground plane," *Electronics Letters,* vol. 36, No. 16, pp. 1343–1345 (Aug. 3, 2000).

Sievenpiper, D. and Eli Yablonovitch, "Eliminating Surface Currents with Metallodielectric Photonic Crystals," *1998 IEEE MTT–S International Microwave Symposium Digest,* vol. 2, pp. 663–666 (Jun 7, 1998).

Sievenpiper, D., et al., "High–Impedance Electromagnetic Surfaces with a Forbidden Frequency Band," *IEEE Transactions on Microwave Theory and Techniques,* vol. 47, No. 11, pp. 2059–2074 (Nov. 1999).

Sevenpiper, D., "High–Impedance Electromagnetic Surfaces," *Ph.D. Dissertation,* Dept. of Electrical Engineering, University of California, Los Angeles, CA, 1999.

Wu, S.T., et al., "High Birefringence and Wide Nematic Range Bis–tolane Liquid Crystals," *Appl. Phys. Lett.,* vol. 74, No. 5, pp. 344–346 (Jan. 1999).

* cited by examiner

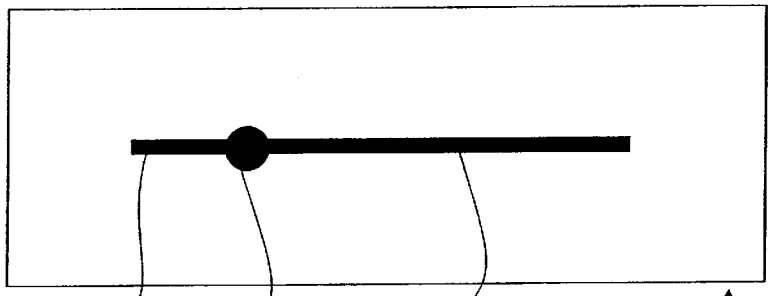
Figure 2a1
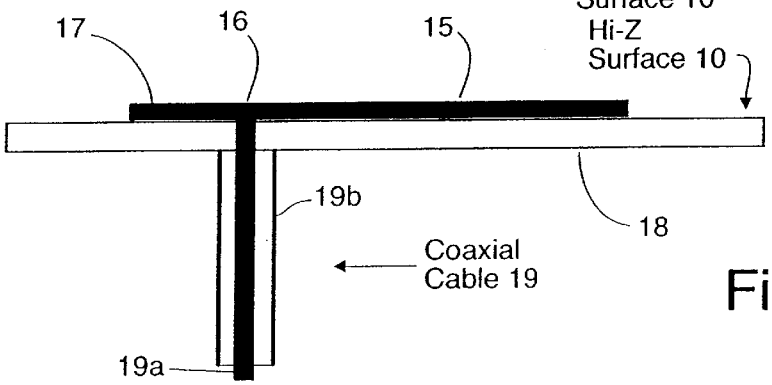
Figure 2a2
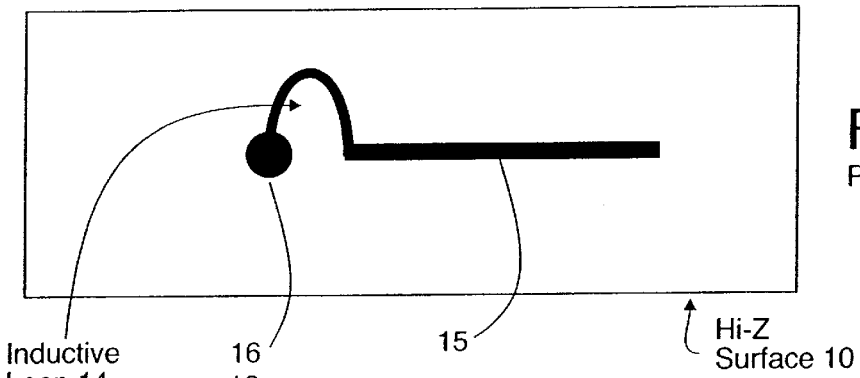
Figure 2b1
Prior Art
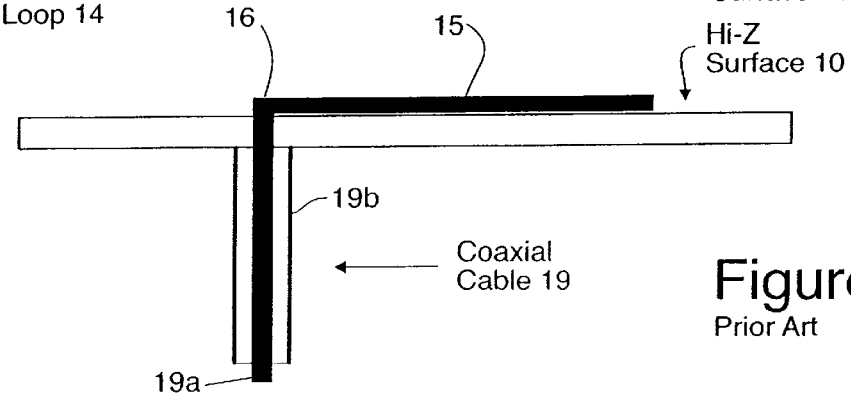
Figure 2b2
Prior Art

ANTENNA SYSTEM FOR COMMUNICATING SIMULTANEOUSLY WITH A SATELLITE AND A TERRESTRIAL SYSTEM

FIELD OF THE INVENTION

This present invention relates to antenna systems which may be used on vehicles to communicate with both a satellite and a terrestrial system.

BACKGROUND OF THE INVENTION

There is currently a need for antennas and/or antenna systems that can communicate with both a satellite and a terrestrial system. One example of such a need is for a Direct Broadcast Satellite (DBS) radio in which radio signals are broadcast from a satellite and are received by a receiver located on vehicle and also received by terrestrial repeaters which rebroadcast the signals therefrom to the same vehicle. Typically, a direct broadcast satellite uses circular polarization so that the vehicle can receive the transmission in any orientation. However, terrestrial networks typically transmit in vertical polarization. If satellite communication fails (for example, if the satellite becomes hidden by a building or other object—manmade or natural) the terrestrially rebroadcast signal can be used to fill in the gaps in the satellite signal.

DBS radio systems typically have a narrow bandwidth (about 0.5%) due to the low power available from satellites, as well as the problems associated with mobile wireless communications. On the other hand, an antenna typically must be designed with at least several percent bandwidth to account for possible errors in manufacturing. For this reason, the antennas used to receive DBS radio signals will generally have a much wider bandwidth than the signals of interest (both satellite and terrestrial), and thus the various components of DBS signals can be considered as being essentially at the same frequency.

There is a need for antennas or antenna systems that can receive radio frequency signals having circular polarization and/or linear vertical polarization. Furthermore, the antenna or antenna system should preferably be able to utilize different radiation patterns for each of these two functions. The antenna or antenna system should have a radiation pattern lobe with circular polarization directed towards the sky, at the required elevation angle for satellite reception, and also have a radiation pattern lobe with linear polarization directed towards the horizon, for terrestrial repeater reception.

Antennas exist that can perform these two functions. For example, a quadrafilar helix antenna, which consists of four wires wound in a helical geometry, can do so. The drawback of this antenna is that it typically protrudes one-quarter to one-half wavelength from the surface of where ever it is mounted and thus if it is mounted protruding from the exterior surface of a vehicle, it results in an unsightly and unaerodynamic vertical structure.

The antenna disclosed herein performs these two functions yet lies essentially flush with the roof of the vehicle. It is able to perform as a dual circular/linear antenna, with the ability to form beams in various directions. It has the added advantage that it can incorporate beam-switched diversity for an improved signal to noise and interference ratio.

This invention improves upon the existing vertical rod antenna that is currently used for satellite and terrestrial radio broadcasts. The disclosed antenna is much less than one-tenth of one wavelength in thickness, and can be placed directly on a metal vehicle roof and lies flush or essentially flush therewith.

The present invention utilizes a Hi-Z surface, a particular kind of ground plane that has been demonstrated to be useful with certain low-profile antennas. The present invention preferably uses four linear wire antenna elements arranged a radial pattern, the four wire antennas being fed by a beam forming network that generates the desired polarizations and beam patterns. Other antenna elements can alternatively be used. The beam forming network has two or more outputs that are routed to a radio receiver, for example (a transceiver could be used if the antenna system is used for both receiving and transmitting signals). The antenna disclosed herein also provides the option for beam switched diversity, providing even better performance. The primary advantage of this antenna is that it is thin, and can be mounted directly on or concealed within the metal roof, for example, of a vehicle.

The prior art includes:

(1) D. Sievenpiper and E. Yablonovitch, "Circuit and Method for Eliminating Surface Currents on Metals" U.S. provisional patent application, serial number 60/079953, filed on Mar. 30, 1998 by UCLA and corresponding PCT application PCT/US99/06884, published as W099/50929 on Oct. 7, 1999, the disclosures of which are hereby incorporated herein by reference.

(2) U.S. Pat. No. 5,929,819, "Flat antenna for satellite communication", by Grinberg, Jan and assigned to Hughes Electronics Corporation. While this patent describes a flat antenna for satellite reception, it is not nearly as flat as the present invention, because it requires elevated lenses. Furthermore, it does not provide for also communicating with a terrestrial system.

(3) U.S. Pat. No. 6,005,521, "Composite antenna", by Suguro, Akihiro and Ookita, Hideto, which patent was assigned to Kyocera Corporation. The antenna disclosed therein provides for diversity reception of signals having different polarizations. However, it is well suited for integrating into a vehicle because of the requirement for a section having a vertical projection.

(4) U.S. Pat. No. 6,081,239, "Planar antenna including a superstrate lens having an effective dielectric constant", by Sabet, Kazem F.; Sarabandi, Kamal; and Katehi, Linda P. B., which patent was assigned to Gradient Technologies, LLC. This patent describes various ways of making a lens having an effective dielectric constant, and the combination of that lens with an antenna. This disclosed concept can be employed with the present invention to control the radiation pattern of the disclosed antenna.

(5) R. Vaughan, "Spaced Directive Antennas for Mobile Communications by the Fourier Transform Method", IEEE Transactions on Antennas and Propagation, vol. 48, no. 7, pp. 1025–1032, July 2000.

(6) P. Perini, C. Holloway, "Angle and Space Diversity Comparisons in Different Mobile Radio Environments", IEEE Transactions on Antennas and Propagation, vol. 46, no. 6, pp 764–775, June 1998.

(7) C. Balanis, *Antenna Theory, Analysis, and Design*, $2^{nd}$ edition, John Wiley and Sons, New York, 1997.

Related applications include the following:

(1) D. Sievenpiper, J. Schaffner, "A Textured Surface Having High Electromagnetic Impedance in Multiple Frequency Bands", U.S. patent application Ser No. 09/713,117 filed Nov. 14, 2000.

(2) D. Sievenpiper, H. P. Hsu, G. Tangonan, "Planar Antenna with Switched Beam Diversity for Interference Reduction in Mobile Environment", U.S. patent application Ser. No. 09/525,831 filed Mar. 15, 2000.

(3) D. Sievenpiper; J. Schaffner; H. P. Hsu; and G. Tangonan, "A Method of Providing Increased Low-Angle Radiation Sensitivity in an Antenna and an Antenna having Increased Low-Angle Radiation Sensitivity", U.S. patent application Ser. No. 09/905,796 filed on the same date as this application.

BRIEF DESCRIPTION OF THE INVENTION

In one aspect, the present invention provides an antenna for receiving circularly polarized signal from a position relatively high in the sky and at the same time linearly polarized signals from a position relatively lower in the sky and closer to the horizon, the antenna comprising a high impedance surface and a plurality of antenna elements disposed on said high impedance surface and arranged in a pattern on said surface, first selected ones of said antenna elements being responsive to circular polarization and second selected ones of said antenna elements being responsive to linear polarization.

In another aspect, the present invention provides a method of receiving circularly polarized signal from a position relatively high in the sky and at the same time linearly polarized signals from a position relatively lower in the sky and closer to the horizon, the method comprising the steps of: providing a high impedance surface; and disposing a plurality of antenna elements on said high impedance surface and arranging the plurality antenna elements in a pattern on said surface such that first selected ones of said antenna elements are responsive to circular polarization and second selected ones of said antenna elements are responsive to linear polarization.

In yet another aspect, the present invention provides an antenna system for receiving both circularly polarized radio frequency signals and linearly polarized radio frequency signals, the circularly polarized signals arriving at the antenna system from a direction normal or oblique to a major surface of the antenna system and the linearly polarized signals arriving at the planar antenna system from a direction acute to said major surface, the antenna system comprising a high impedance surface and a plurality of antenna elements disposed on said high impedance surface, the plurality antenna elements arranged in a pattern on said surface such that first selected ones of said antenna elements are responsive to circular polarization and second selected ones of said antenna elements are responsive to linear polarization.

BRIEF DESCRIPTION OF THE DRAWINGS

FIGS. 2*a*1 and 2*a*2 depict one scheme while FIGS. 2*b*1 and 2*b*2 depict another scheme for impedance matching a wire antenna with a 50 Ohm impedance circuit—heretofore wire antenna typically had a capacitive reactance and a small inductive loops section is required as is shown by FIGS. 2*b*1 and 2*b*2; however, in the present design it was determined that the wire antenna has a natural inductive reactance, and a small capacitive tail section is required as is shown by FIGS. 2*a*1 and 2*a*2;

DETAILED DESCRIPTION OF A PREFERRED EMBODIMENT

Figure 1:
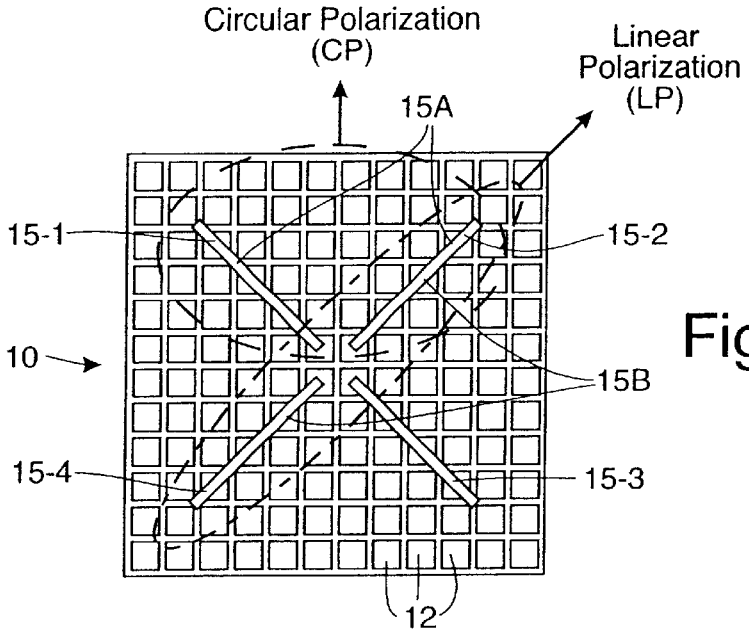
FIG. 1 depicts the radiating section of the presently disclosed antenna system which includes a region of Hi-Z surface and four radiating wires which extend radially from the center of the Hi-Z surface.

This invention utilizes a high impedance (Hi-Z) surface, a type of ground plane that has recently been developed that allows antennas to lie directly adjacent to a metal surface without being shorted out, and at the same time maintaining an antenna impedance near 50 Ohms. The Hi-Z surface exhibits a relatively higher impedance at a frequency of interest (usually the center frequency for the band of interest of the antennas) and having a relatively lower impedance at frequencies higher and lower than the frequency of interest. This new surface also allows one to control the excitation of surface waves on the surrounding ground plane. This allows one to control the radiation pattern of the antenna, in particular the amount of radiation that is emitted at low elevation angles.

A Hi-Z surface is preferably used in this invention for several reasons:

(1) a Hi-Z surface permits the antenna to have a small thickness, i.e, to be low-profile (in this case the thickness can be as small as on the order of one-hundredth of one wavelength of the normal operating frequency of the antenna disposed thereon), p1 (2) a Hi-Z surface allows the antenna and Hi-Z surface combination to lie directly adjacent to the metal roof of a vehicle, and (3) a Hi-Z surface controls the excitation of surface currents in the surrounding metal ground plane and thereby controls the radiation pattern.

The Hi-Z surface, which is described in PCT application PCT/US99/06884, published as W099/50929 on Oct. 7, 1999, consists of a flat metal surface covered with a two dimensional lattice of metal plate-like protrusions. These protrusions are capacitively coupled to their neighbors and are inductively coupled to an adjacently disposed ground plane. Hi-Z surfaces have been constructed using printed circuit board technology. The sheet capacitance is controlled by the proximity of the metal protrusions to their neighbors, or their overlap area, and can be designed to have a desired value by adjusting the geometry of the protrusions when they are formed on a printed circuit board, for example. The sheet inductance of the structure is controlled by its overall thickness. Thus, one can tune the capacitance and inductance, and thereby tune the effective sheet impedance of the surface, which is effectively equal to a LC circuit made up of the sheet capacitance and sheet inductance. Near the resonance frequency given by:

$$\omega = \frac{1}{\sqrt{LC}},$$

the structure has a high surface impedance. At this frequency the reflection phase crosses through zero, and the surface behaves as an artificial magnetic conductor. It has impedance >377 Ohms over a bandwidth given by:

$$BW = \frac{\sqrt{L/C}}{\sqrt{\mu_o/\varepsilon_o}}.$$

where L is the sheet inductance, C is the sheet capacitance, $\mu_0$ is the magnetic permeability of free space, and $\epsilon_0$ is the electric permittivity of free space.

Within this bandwidth, a Hi-Z surface structure suppresses the propagation of surface waves. This effect can be described as a surface wave band gap. Within the band gap, since the surface has high sheet impedance, it also allows antennas to lie directly adjacent to it without being shorted out. This allows the antenna to be very thin, because it eliminates the requirement for one-quarter wavelength separation between the antenna and the ground plane. Near the upper edge of the surface wave band gap, the structure supports transverse electric (TE) surface waves, which exist as leaky waves, meaning that they radiate from the surface. The upper edge of the band gap can be defined as the resonance frequency plus one-half the bandwidth, $\omega_{res}$+BW/2. This is actually the point where the reflection phase crosses through −90 degrees, and generally corresponds to the upper edge of the surface wave band gap as well. Leaky TE waves are usually supported in the range between $\omega_{res}$ and $\omega_{res}$+BW/2. For a small area (one that is equal to or less than one square wavelength) of a high-impedance surface, these leaky TE waves can be used to excite transverse magnetic (TM) waves on a surrounding ground plane consisting of ordinary metal. Both the leaky TE waves and the secondary TM waves can be used to increase the low angle radiation intensity of an antenna as described in U.S. patent application Ser. No. 09/905,796 filed on the same date as this application. This effect may be exploited in this invention as well.

It is known in the art how to engineer the band gap of the Hi-Z surface to a desired center frequency and therefore the techniques used to design the Hi-Z surface are not described here. The reader is instead directed to D. Sievenpiper and E. Yablonovitch, "Circuit and Method for Eliminating Surface Currents on Metals" U.S. provisional patent application serial number 60/079953, filed Mar. 30, 1998 and corresponding PCT application PCT/US99/06884, published as WO99/50929 on Oct. 7, 1999, the disclosures of which are hereby incorporated herein by reference.

The disclosed antenna also takes advantage of the concept of antenna diversity, which by itself is know in the prior art (see the articles by Vaughan and/or Perini & Holloway noted previously). In the related applications referred to above, an antenna, disposed upon a Hi-Z surface that includes switched beam diversity of either horizontal or vertical polarization using either a flared notch antenna or wire antenna, is described. In the present application, these concepts are expanded upon preferably to include both improved low angle radiation and a new antenna feeding network, which allows the antennas to provide multiple beams and multiple polarizations simultaneously, in order to allow access to both a satellite and a terrestrial network, simultaneously. Specifically, the disclosed antenna system produces a radiation pattern lobe towards the sky having circular polarization and a radiation pattern lobe towards the horizon having vertical linear polarization. Furthermore, each of these two lobes can occur simultaneously, with separate RF outputs being routed to an external diversity combiner. This allows signals from both a satellite and a terrestrial network to be used simultaneously by a receiver downstream of the diversity combiner. This is in addition to the switched beam diversity already present in the antenna itself.

A first embodiment of the antenna is shown in FIG. 1. It includes of a region of Hi-Z surface 10 which is shown as being square, but it can be circular or of any other desired shape. The Hi-Z surface includes an array of plate-like conductive elements 12 which are spaced from each other and disposed on a dielectric substrate. Upon the Hi-Z surface 10 are disposed four linear wire antenna elements 15 each one of which is identified by the designations 15–1 through 15–4. The wire antennas 15 are generally ⅓ to ½ wavelength long, at the resonance frequency of the Hi-Z surface 10, and operate most efficiently within the band gap of the Hi-Z surface 10. These four wire antenna elements 15 are fed near the center of the surface 10. Each wire antenna 15 preferably extends radially towards the periphery of the surface 10 along preferably orthogonal axes X and Y (see FIG. 1*a*). Pairs or groups of antenna elements 15 may be combined with varying phase to produce nearly any desired radiation pattern or polarization. As will be seen, orthogonal pairs 15A of antenna elements 15 may be combined with a 90 degree phase shift element to produce circular polarization (CP). Collinear pairs 15B of antenna elements 15 may be combined with various phases to produce various radiation patterns having linear polarization (LP).

Figure 1A:
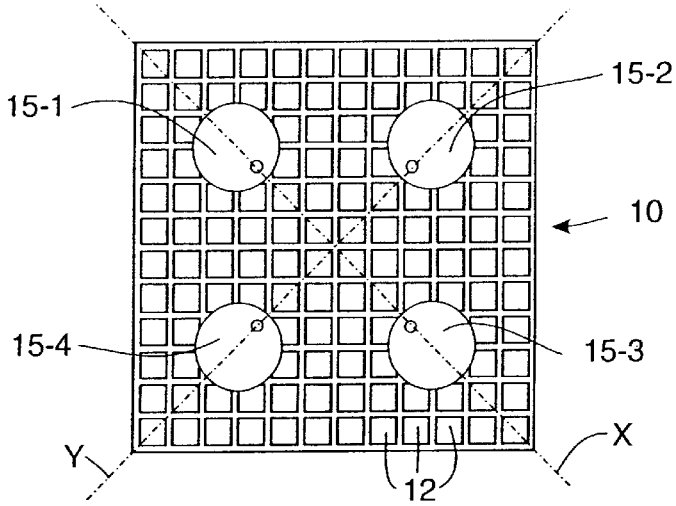
FIG. 1*a* is similar to FIG. 1 and shows an alternative design with four patch antennas arranged on a Hi-Z surface.

A second embodiment of the antenna is shown in FIG. 1*a* wherein the four linear wire antenna elements 15 have been replaced by four patch antenna elements identified by numerals 15-1 through 15-4. These patch antenna elements serve the same purpose as do the linear wire antenna elements. The antenna elements 15, whether occurring as wire antenna elements or patch antenna elements or otherwise, are all preferably identical to each other and are arranged in a regular repeating pattern on the surface 10. Of course, the orientations of the individual elements may be different. The patterns shown in FIGS. 1 and 1a may repeat numerous times on a single high impedance surface 10. Furthermore, antenna systems may have radial patterns of antenna elements, for example, extending along axes X and Y, comprising more than four antenna elements 15 or less than four antenna elements 15 can be used with greater or lesser performance, respectively, and with greater or lesser complexity, respectively.

A more detailed representation of a single linear antenna element 15 of the first embodiment of the antenna is shown by FIGS. 2*a*1–2*a*2 and 2*b*1–2*b*2. It has been determined experimentally that a good impedance match can be made between wire antenna elements 15 and a 50 Ohm coax cable 19 by extending an additional piece or stub of wire 17 from the feed point 16 in a direction opposite to the direction taken by antenna element 15, as is shown in FIG. 2*a*1–2*a*2. Since the wire antenna elements 15 extend towards the periphery of the surface, the stubs 17 extend toward the center of the surface 10. The stubs 17 are tuned experimentally, but each generally has a length equal to or less than one-quarter of the overall length of the antenna element. The feed point 16 between the stub 17 and the wire antenna element 15 is directly coupled to the center conductor 19*a* of the coax cable 19 while the ground shield 19*b* of the coax cable 19 is coupled to the ground plane 18 of the Hi-Z surface 10. The coax cable can have an impedance other than 50 Ohms, but 50 Ohms is preferred since that is believed to provide a good impedance match with the antenna elements 15. Many such antenna elements which have been studied in the past on Hi-Z surfaces have had an inherent capacitive component in their input impedance. These earlier antenna designs have required the addition of a loop-like structure 14 near the feed point as is shown by FIG. 2*b*1. In the case of the present invention, the input impedance of the antenna element 15 is inductive. A good input impedance match to the preferred 50 Ohm cable 19 can be obtained using the stub structure 17 described here with reference to FIGS. 2*a*1–2*a*2 for each wire antenna element 15.

Two techniques by which the radiation pattern of a single antenna element 15 may be adjusted for improved low angle performance will now be described. One technique is to make the effective length of the wire slightly longer than one-half wavelength. This creates a null in the radiation pattern which is offset from normal in the direction of the antenna feed, and creates a broad main beam that is biased towards the other end of the antenna. This can be considered as a quasi-traveling wave antenna. Another technique for increasing the low angle radiation intensity is to operate the Hi-Z surface near the upper edge of the band gap. This technique is described by J. Schaffner; H. P. Hsu; G. Tangonan; and D. Sievenpiper in a US patent application entitled "A Method of Providing Increased Low-Angle Radiation Sensitivity in an Antenna and an Antenna having Increased Low-Angle Radiation Sensitivity", U.S. patent application Ser. No. 09/905,796 filed Jul. 13, 2001. Either or both of these methods may be used with this invention for improving the low angle performance of the antenna. Low angle radiation is important, especially for the terrestrial repeater network, because the terrestrial base stations (repeaters) are typically located near the horizon. Another way of controlling the radiation pattern of an antenna is to use a dielectric lens, as described in the prior art (see U.S. Pat. No. 6,081,239 mentioned above). This concept can be used with the presently described antenna system as well.

Figure 3:
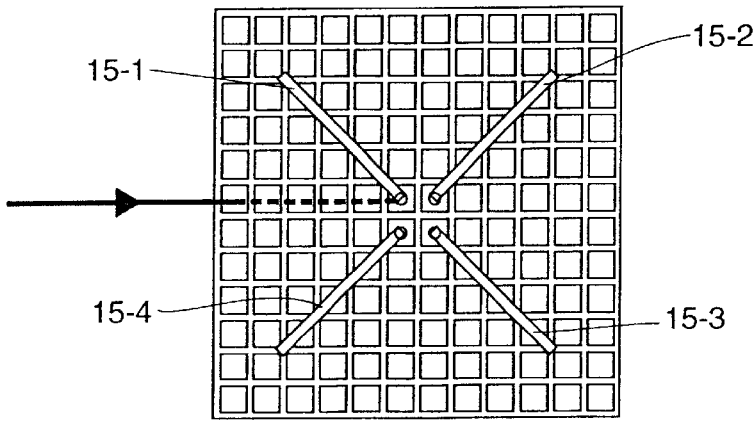
FIG. 3 is a diagram showing an experimental setup which was used for measuring a single wire antenna in which wire antenna #1 was attached to our antenna measurement system, while wires antennas #2–4 were attached to a 50 Ohm load.
Figure 4:
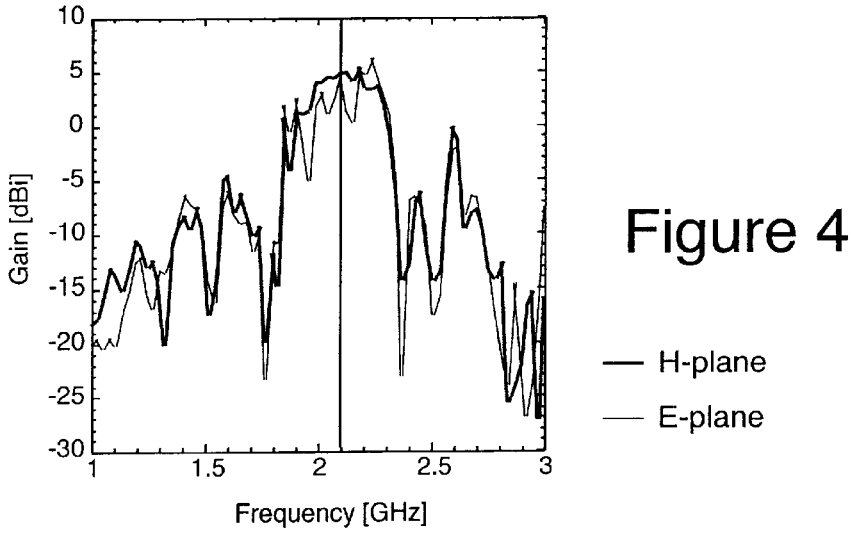
FIG. 4 depicts the gain of a single wire antenna as a function of frequency in the direction normal to the surface according to the experiment conducted in the set up of FIG. 3.
Figure 5:
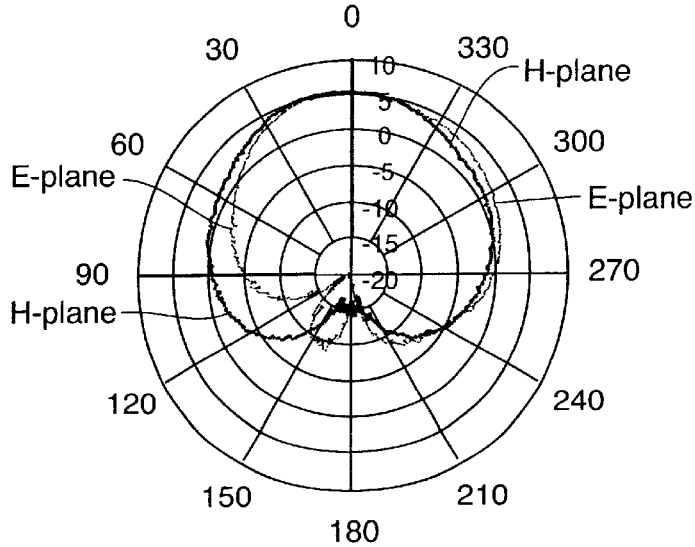
FIG. 5 depicts the radiation pattern of the single wire antenna in the E-Plane (thinner line) and the H-Plane (thicker line) according to the experiment conducted in the set up of FIG. 3.

Functions that can be performed with a four element antenna and its properties will now be described. FIG. 3 shows the four element antenna with wire antenna element being 15-1 addressed directly for purpose of an experiment. Antennas 15-2 through 15-4 are terminated with a matched load in this experiment. FIG. 4 shows the gain of this antenna at broadside as a function of frequency according to experimental data which was obtained connecting the antenna as shown by FIG. 3. It can be seen from the plot of FIG. 4 that the antenna of this embodiment has a bandwidth of roughly 20% which is quite acceptable for many applications. The operating band of the antenna of this embodiment is centered around 2.1 gigahertz and the resonance frequency of the Hi-Z surface 10 utilized in the experiment was also centered around 2.1 gigahertz. The radiation pattern, in an elevation view, of this antenna is shown in FIG. 5. It is broad in both the E-Plane in the H-Plane, which means that by using common array techniques (see the book by C. Balanis noted above) one may produce radiation patterns covering a broad range of angles and having a variety of polarizations. Of course, this antenna and its Hi-Z surface can be easily modified for use in other frequency ranges.

Figure 6:
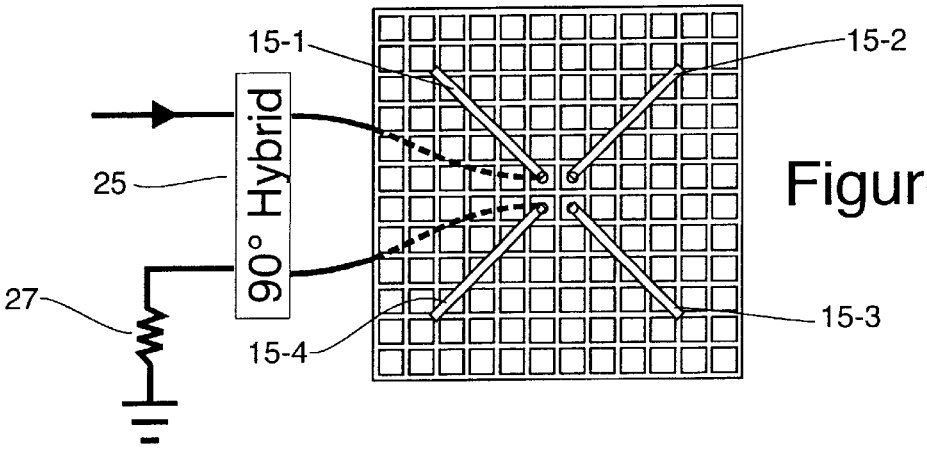
FIG. 6 is a diagram showing experimental setup for measuring the radiation and gain patterns of a pair of orthogonal wire antenna elements driven out of phase by 90 degrees.
Figure 7:
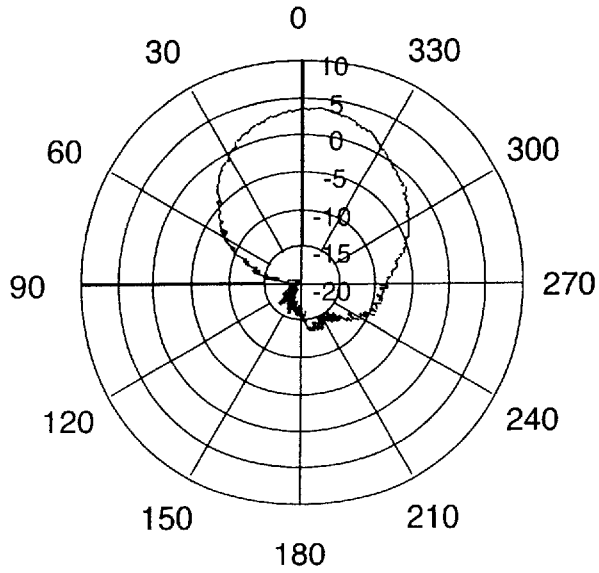
FIG. 7 depicts the radiation pattern of the two orthogonal antenna elements shown in FIG. 6, this pattern representing radiation along a symmetry plane between the two wires.

In order to produce circular polarization (CP) for the purpose of communicating with an orbiting satellite, one must combine two orthogonal linear components with a relative phase delay of 90 degrees. This may be done using a 90 degree hybrid 25 as shown in FIG. 6. The function of the 90 degree hybrid is known to those skilled in the art of microwave components and 90 degree hybrids, as well as other microwave elements mentioned herein, are commercially available from Anaren Microwave of East Syracuse, NY, USA. The two output ports of the hybrid 25 produce opposite circular polarizations. In an experiment to test the suitability of the antenna system for use with satellites, antenna element 15-1 and antenna element 15-4 were attached to a 90 degree hybrid 25 which allowed the two elements to be driven out of phase by 90 degrees. In this experiment, antenna elements 15-1 and antenna element 15-4 were fed using the 90 degree hybrid 25 with the unused port on the hybrid being terminated with a 50 Ohm load 27. The radiation pattern for this antenna arrangement according to this experiment was measured and FIG. 7 shows the detected radiation pattern, in an elevation view, measured with a circularly polarized remote antenna. This radiation pattern is taken in the plane of mirror symmetry between the two antenna elements. The radiation pattern is slightly asymmetric because since two orthogonal elements out of the four are being driven, which two are next to each other on one side of the Hi-Z surface. Hence, the antenna is not entirely symmetric, resulting in an asymmetric pattern. The radiation pattern is broad and oriented towards the sky with a slight bias towards one direction.

Figure 8:
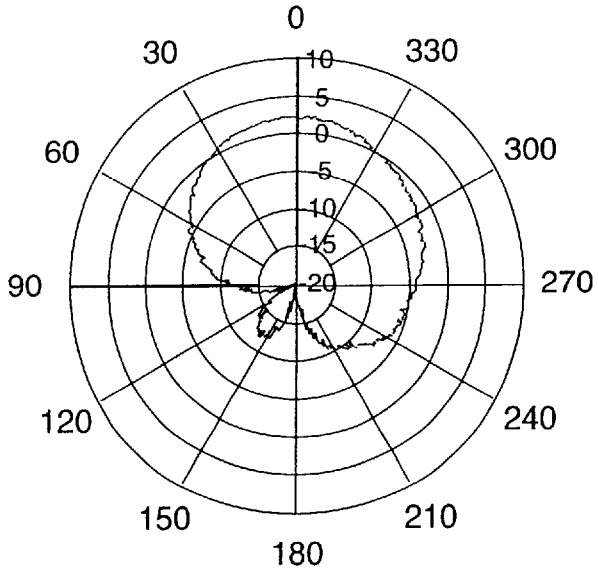
FIG. 8 depicts the radiation pattern of the two orthogonal antenna elements shown in FIG. 6, this pattern representing radiation along the plane which is orthogonal to both the symmetry plane between the two antenna elements and the plane of the Hi-Z surface.

The radiation pattern in an orthogonal plane, in an elevation view, is shown in FIG. 8. This radiation pattern represents radiation along a plane which is orthogonal to both the symmetry plane between the two wires and the plane of the Hi-Z surface 10. This radiation pattern is also slightly asymmetric as a result of the natural asymmetry introduced by the 90 degree hybrid 25.

Figure 9:
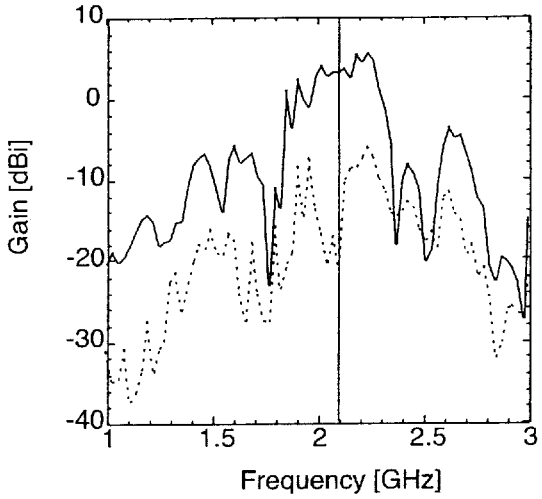
FIG. 9 graphs the gain of the two orthogonal antenna elements shown in FIG. 6 as a function of frequency in a direction normal to the Hi-Z surface for both co-polarized radiation and for cross-polarized radiation.

FIG. 9 shows the gain at broadside of this pair of antenna elements taken with two different circular polarizations. The gain of the two orthogonal wire antenna elements as a function of frequency in a direction normal to the surface. The solid line is for co-polarized radiation while the dashed line is for cross-polarized radiation. FIG. 9 shows that this antenna produces very good circular polarization, having a polarization ratio ranging from 10 to 20 decibels. This radiation pattern is well suited for communicating with an orbiting satellite. This radiation pattern can also be adjusted toward lower angles using the methods described herein.

Figure 10:
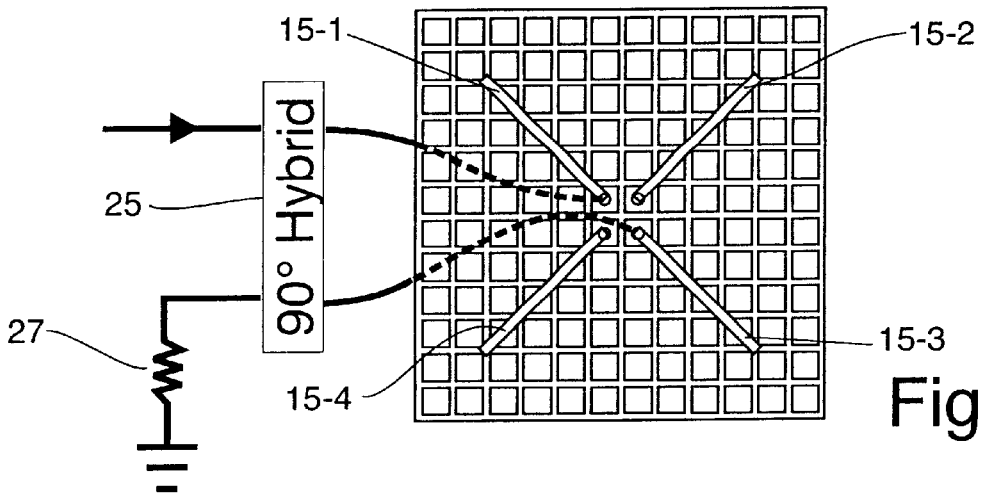
FIG. 10 is a diagram showing experimental setup for measuring the radiation pattern of a pair of co-linear wire antenna elements driven out of phase by 90 degrees.
Figure 11:
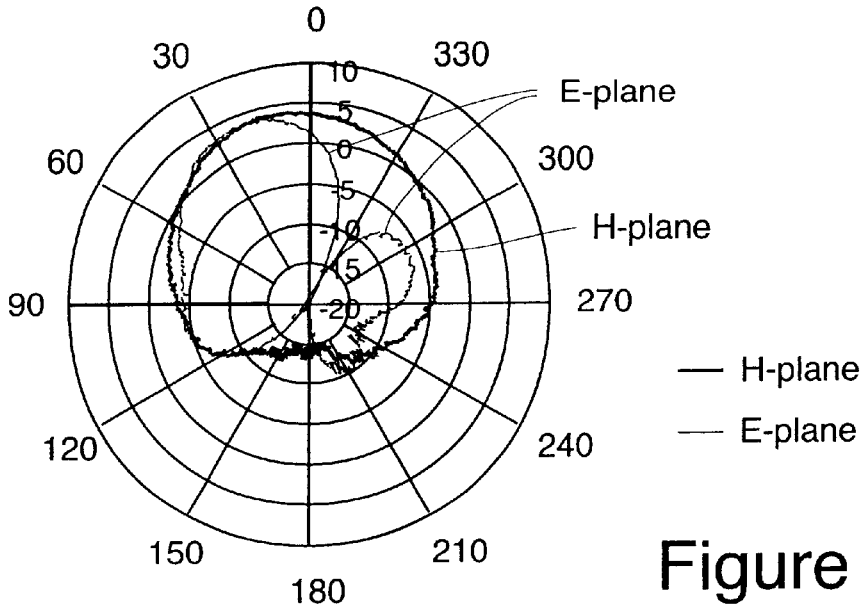
FIG. 11 depicts the radiation pattern of the two co-linear antenna elements shown in FIG. 10, this pattern representing radiation from a top or plan view.

The suitability of the antenna system for use with terrestrial communications systems using a vertically polarized radiation pattern lobe was also tested. FIG. 10 shows the same four antenna element 15 antenna system with a 90 degree hybrid 25 connected between antenna element 15-1 and antenna element 15-3. The 90 degree phase delay causes the combination of the two co-linear antenna elements 15-1, 15-3 to produce a two lobe pattern in the E-plane as is shown in FIG. 11. The E-plane is shown in a thin line while the H-plane is shown by a thicker line. The antenna elements in this experiment produce a pattern which is biased toward one direction, with the direction being determined by which antenna element receives the 90 degree phase delay. Other phase delays may be used, but the 90 degree hybrid was convenient for the experiments which were performed. Driving the two antenna elements with varying relative phase allows one to produce different radiation patterns in the plane which contains the two antennas and is orthogonal to the Hi-Z surface 10. The pattern shows one large lobe directed toward one direction and one small lobe in the opposite direction. The position of the large lobe may be adjusted by varying the phase delay between the two antennas. In the direction of the main lobe the antenna system has vertical polarization, which is ideal for communicating with a terrestrial network. Neither this nor the previously discussed experiment included any features or techniques mentioned or described elsewhere herein for improving low angle radiation. However, such techniques may be employed to further improve the antenna system's ability to cope with low angle radiation sources.

Many of the embodiments of the invention described above utilize antenna elements which are elongate wire elements. The invention is not limited to that type of antenna element. Indeed, the concepts disclosed herein can be used in connection with any type of antenna capable of being disposed on Hi-Z surface 10, including, for example, patch antennas and flared notch antennas. See, for example, the embodiment depicted by FIG. 1*a*. The number of antenna elements 15 shown on the high impedance surface 10 in the figures is four, but it should be appreciated that the number of antenna elements 15 utilized on a given high impedance surface 10 can be far greater than four. Four antenna elements 15 are used in the disclosed embodiments since the disclosed antennas can function with as few a four antenna elements 15 and it is convenient to describe the antenna works in terms of an antenna with four elements 15. Antennas with greater numbers of antenna elements 15 would typically arrays of antenna elements disposed on a high impedance surface, the arrays preferably comprising regular repeating patterns of substantially identical antenna elements 15 preferably arranged in groups of four antenna elements 15.

Figure 12:
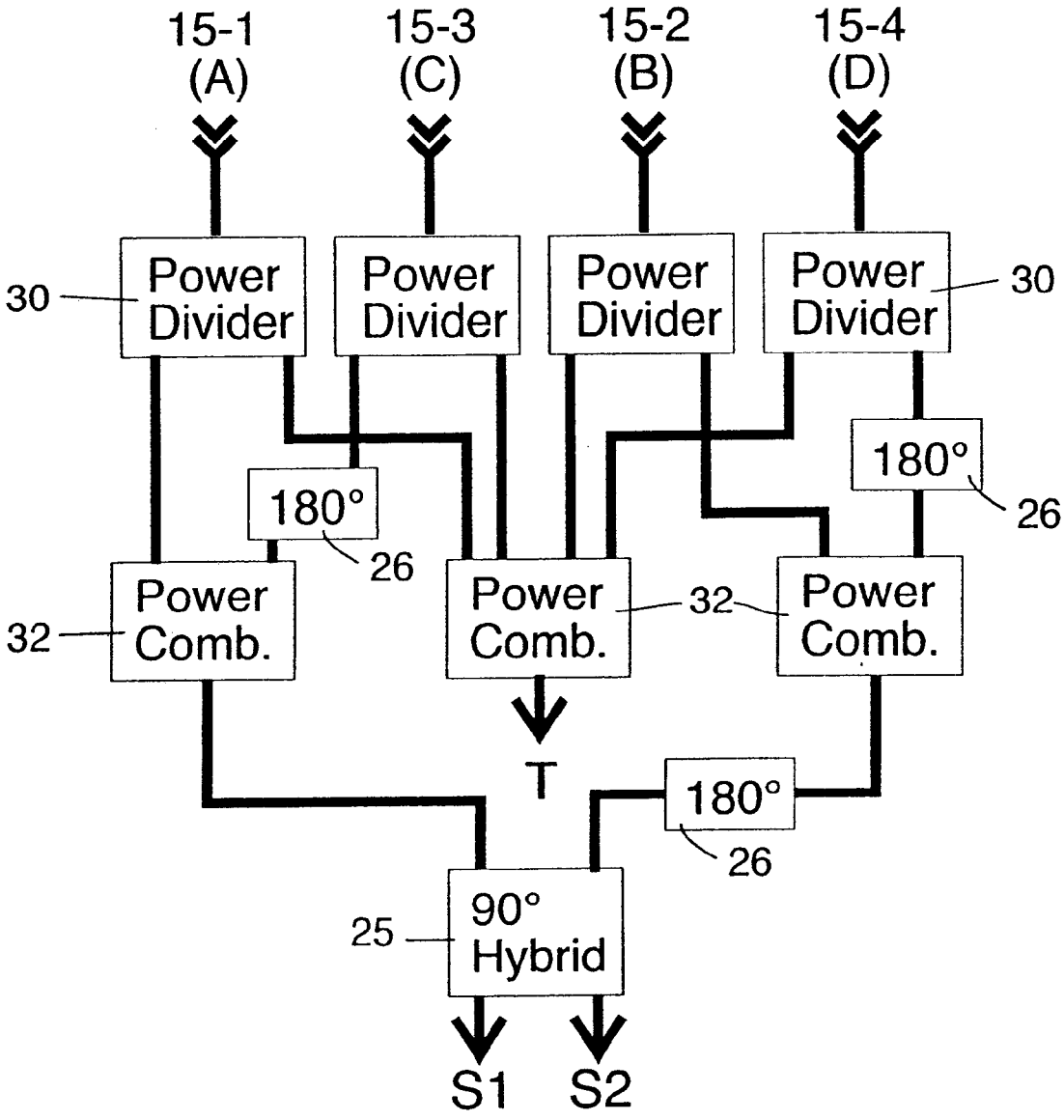
FIG. 12 is a schematic diagram of a simple combining network for producing two outputs, one for a terrestrial communication system and another a for satellite communication system.

Having described various ways to produce a various radiation patterns having various polarizations using a four element antenna, the feeding or combining network which may be used to couple antenna elements 15 is now described. There several possible combining networks that can produce the functions described above in connection with the reported experimental data. The simplest example is to combine the feed points of the four antenna elements 15 with equal phase, to produce an output for signals received from a terrestrial network. One can then combine the outputs from orthogonal pairs of antenna elements with a 90 degree phase delay to produce an output for a received satellite signal. This produces left handed or right handed circular polarization, with the orientation determined by which pair of wires receives the 90 degree phase delay. This simple example of a feeding or combining network is illustrated in FIG. 12 and is described in Table I. As shown in FIG. 12, the feed point of each antenna element 15-1 through 15-4 is split or divided into separate branches by a power divider 30 and the branches are then recombined with the appropriate phase delay (180° for one of the two signals delivered to the 90° hybrid and 180° for the signals delivered by antennas 15-3 and 15-4 to the two input power combiners 32—see elements 26) to produce the functions described below. The terrestrial signal is retrieved at the output labeled T, whereas the satellite signals are received at the outputs labeled S1 and S2. Because the 90 degree hybrid has two outputs, one may actually obtain both left and right hand circular polarizations simultaneously; however, this is not needed for many satellite systems and therefore use of only one of the two outputs S1 or S2 may suffice in many applications. Table I describes the simplest possible combining network. It does not provide for antenna diversity.

TABLE I

The function produced by the network shown in FIG. 12, where:

| Terrestrial | Satellite |
|---|---|
| A + B + C + D | A − C + j(B − D) |

A = the feedpoint for antenna 15-1;
B = the feedpoint for antenna 15-2;
C = the feedpoint for antenna 15-3; and
D = the feedpoint for antenna 15-4.

In FIG. 12, the feed points of the four antenna elements 15-1 through 15-4 are connected four power divider circuits 30. In this embodiment, the power dividers 30 each have two outputs. Power combiners 32 either add or subtract their inputs according to the logic set forth in Table I. The signals S1 and S2 are obtained from the outputs of the 90 degree hybrid 25. These RF components are commercially available from Anaren Microwave of East Syracuse, NY, USA.

Figure 13:
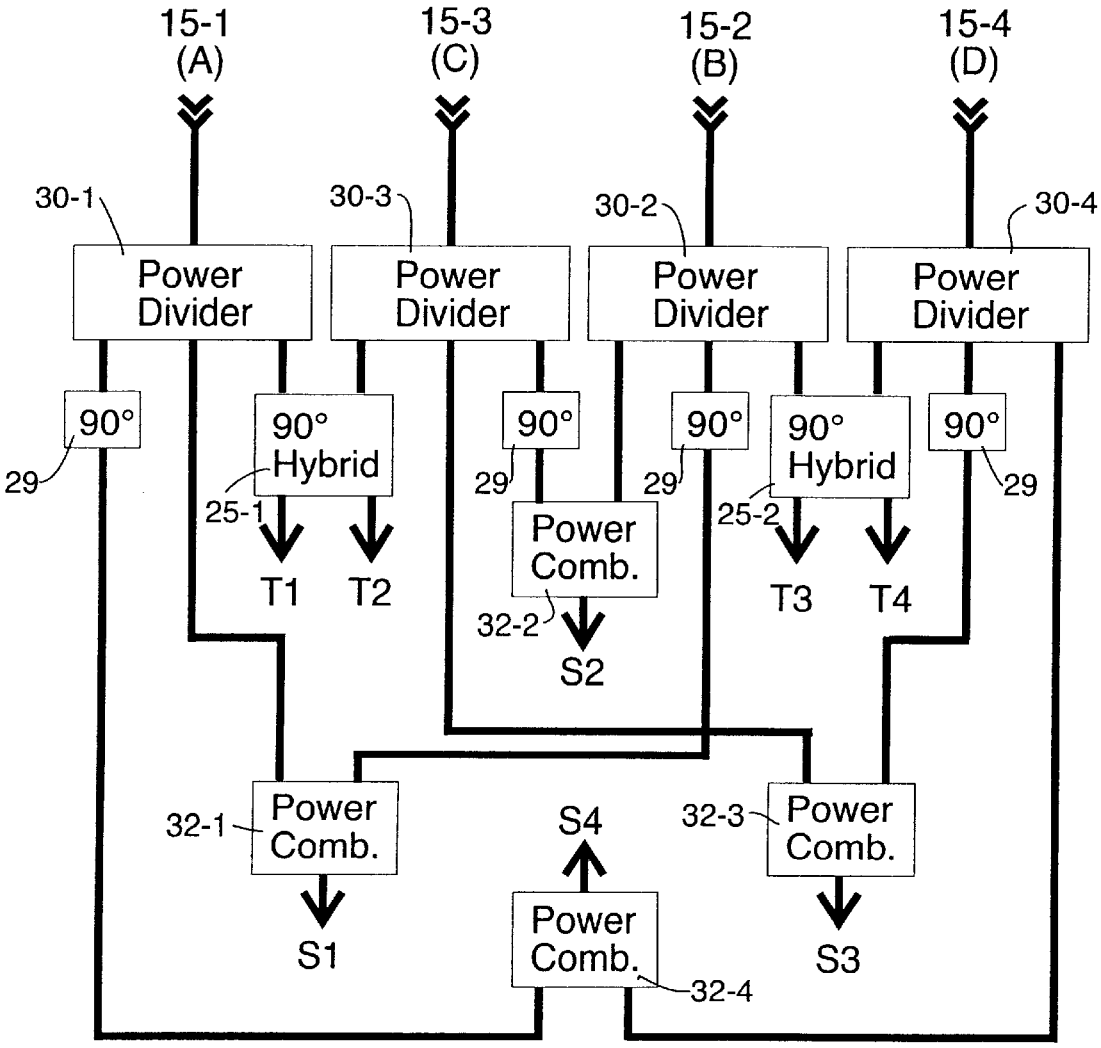
FIG. 13 is a schematic diagram of a more complicated combining network.

A more complicated combining network is shown in FIG. 13 and described in Table II. In this example, the antenna provides for switched beam diversity in both the satellite signal and the terrestrial signal. Each signal has four possible outputs, labeled T1 through T4 for the terrestrial systems and Si through S4 for the satellite system. Each of these outputs represents a beam at a different angle, and the receiver may switch between beams or use multiple beams simultaneously to maximize the received signal to noise and interference ratio.

TABLE II

The function produced by the network shown in FIG. 13, where:

| Terrestrial | Satellite |
|---|---|
| A + jC | A + jB |
| C + jA | B + jC |
| B + jD | C + jD |
| D + jB | D + jA |

A = the feedpoint for antenna 15-1;
B = the feedpoint for antenna 15-2;
C = the feedpoint for antenna 15-3; and
D = the feedpoint for antenna 15-4.

In FIG. 13, the feed points of the four antenna elements 15-1 through 15-4 are each connected to one of four power divider circuits 30, which are separately identified as dividers 30-1 through 30-4 for this embodiment. In this embodiment, the power dividers 30 each have three outputs and such power dividers are commercially available from Anaren Microwave. The signals S1 through S4 are obtained from the outputs of four power combiners 32 which are separately identified as 32-1 through 32-4. Each power combiner has two inputs and is commercially available from Anaren Microwave. The signals T1 through T4 are provided at the outputs of two 90 degree hybrid circuits 25, which are separately identified as hybrids 25-1 and 25-2 and are commercially available from Anaren Microwave. Four 90 degree circuits 29 are also provided which may also be obtained from Anaren Microwave.

In this more complicated embodiment:

(1) one output from each divider 30-1 and 30-3 is applied to hybrid 25-1 while one output from each divider 30-2 and 30-4 is applied to hybrid 25-2. Hybrid 25-1 outputs signals T1 and T2 while hybrid 25-2 outputs signal T3 and T4.

(2) one output from each divider 30-1 and 30-2 is applied to combiner 32-1 with the signal in the leg from divider 30-2 being subjected to a 90 degree phase change while one output from each divider 30-3 and 30-4 is applied to combiner 32-3 with the signal in the leg from divider 30-4 being subjected to a 90 degree phase change. Combiner 32-1 outputs signal S1 while combiner 32-3 outputs signal S3.

(3) one output from each divider 30-3 and 30-2 is applied to combiner 32-2 with the signal in the leg from divider 30-3 being subjected to a 90 degree phase change while one output from each divider 30-1 and 30-4 is applied to combiner 32-4 with the signal in the leg from divider 30-1 being subjected to a 90 degree phase change. Combiner 32-2 outputs signal S2 while combiner 32-4 outputs signal S4.

FIG. 13 is a rather "brute force" approach to the problem of providing a feed or combining network with antenna diversity capabilities. The CP outputs are obtained from combining adjacent elements in phase quadrature, while the LP outputs are obtained by combining opposite elements in phase quadrature. The appropriate phases are produced by 90 degree delays using 90 degree hybrids. Those skilled in the art of microwave circuits will likely devise other embodiments, including simpler embodiments, for carrying out the functions noted above, but the circuit shown by FIG. 13 illustrates the concepts involved.

Although specific examples of a simple and a complicated combining network have been given, this invention is not limited to the examples given. The construction of microwave networks is known to those skilled in the art of microwave networks, and other examples will clearly present themselves to those skilled in the art who read this specification. For example, differing amount of phase delay than the amount indicated by be used in some embodiments and indeed it may be desirable in some embodiments to make the amount (degrees) of phase delay variable. Also, not all signals will be needed for all applications and therefore some practicing the present invention may well choose to make certain simplifications. For example, it has already been mentioned that having both right and left handed circular polarizations may be unnecessary in certain applications.

The antenna elements have been described herein as being wire antennas. It should be realized that the present invention (i) is not limited to using wire antennas as the antenna elements and (ii) is not limited to using only four antenna elements on a Hi-Z surface. Four antenna elements are disclosed herein since the experiments related herein were done on the basis of a four element antenna. It is to be understood however that increasing the number of antenna elements is likely to improve the beam diversity switching capabilities of the antenna system with a related increase in the complexity of the combining network.

The surface upon which the antenna elements are disposed should function like a Hi-Z surface, i.e., by having a relatively high impedance in a frequency band of interest. Thus, the invention is not limited to just the Hi-Z surfaces previously described herein.

What is claimed is:

1. An antenna system comprising:

(a) a high impedance surface having a relatively higher impedance at a frequency of interest and having a relatively lower impedance at frequencies higher and lower than the frequency of interest;

(b) a set of elongate wire antennas disposed on said high impedance surface with their major axes disposed immediately adjacent said high impedance surface, each elongate antenna having a feed end arranged such that the feed end of each elongate wire antenna is disposed closer to a central portion of said high impedance surface than to a peripheral portion of said high impedance surface, each elongate wire antenna having a distal end directed towards the peripheral portion of said high impedance surface;

(c) each elongate wire antenna being associated with an impedance matching stub attached by a first end of the stub at the feed end the associated wire antenna, each impedance matching stub having a distal end remote from the first end thereof, the distal ends of said stubs being disposed closer to the central portion of the high impedance surface than are the first ends thereof; and (d) an antenna coupling arrangement coupled to the feed ends of said antennas for passing circularly polarized electromagnetic signals received by the antenna system to a first output thereof and for passing vertically polarized electromagnetic signals received by the antenna system to a second output thereof.

2. The antenna system of claim 1 wherein the antenna coupling arrangement passes right handed circularly polarized electromagnetic signals received by the antenna system to said first output thereof and passes left handed circularly polarized electromagnetic signals received by the antenna system to a third output thereof.

3. A planar antenna system for receiving both circularly polarized electromagnetic signals and linearly polarized electromagnetic signals, the circularly polarized signals arriving at the planar antenna system from a direction normal or oblique to a major surface of the antenna system and the linearly polarized signals arriving at the planar antenna system from a direction acute to said major surface, the antenna system comprising:

a high impedance surface;

a plurality of antenna elements disposed on said high impedance surface, the plurality of antenna elements arranged in a pattern on said surface such that selected pairs of said antenna elements occur either (i) on one half of one side of said surface or (ii) in a linear relationship on one side of said surface; and an antenna coupling arrangement coupled to said antenna elements for passing circularly polarized electromagnetic signals received by the antenna system to a first output thereof and for passing linearly polarized electromagnetic signals received by the antenna system to a second output thereof.

4. The antenna system of claim 3 wherein the antenna coupling arrangement passes right handed circularly polarized electromagnetic signals received by the antenna system to said first output thereof and passes left handed circularly polarized electromagnetic signals received by the antenna system to a third output thereof.

5. The antenna system of claim 3 wherein the antenna elements of the plurality of antenna elements are substantially identical to each other.

6. An antenna system for receiving both circularly polarized electromagnetic signals and linearly polarized electromagnetic signals, the circularly polarized signals arriving at the antenna system from a direction normal or oblique to a major surface of the antenna system and the linearly polarized signals arriving at the planar antenna system from a direction acute to said major surface, the antenna system comprising:

a high impedance surface; and a plurality of antenna elements disposed on said high impedance surface, the plurality of antenna elements arranged in a pattern on said surface such that first selected ones of said antenna elements are responsive to circular polarization and second selected ones of said antenna elements are responsive to linear polarization.

7. The antenna system of claim 6 further including an antenna element coupling arrangement coupled to said antenna elements for passing circularly polarized electromagnetic signals received by said first selected ones of said antenna elements to a first output thereof and for passing linearly polarized electromagnetic signals received by said second selected ones of said antenna elements to a second output thereof.

8. The antenna system of claim 7 wherein the first and second selected one of said antenna elements each comprise pairs of antenna elements.

9. The antenna system of claim 8 wherein each antenna element is a wire antenna element with an antenna stub commonly connected to a feed point.

10. The antenna system of claim 7 wherein the antenna coupling arrangement passes right handed circularly polarized electromagnetic signals received by the antenna system to said first output thereof and passes left handed circularly polarized electromagnetic signals received by the antenna system to a third output thereof.

11. The antenna system of claim 6 wherein the antenna elements of the plurality of antenna elements are substantially identical to each other.

12. A method of receiving circularly polarized signals from a position relatively high in the sky and at the same time linearly polarized signals from a position relatively lower in the sky and closer to the horizon, the method comprising the steps of:

(a) providing a high impedance surface; and (b) disposing a plurality of antenna elements on said high impedance surface and arranging the plurality of antenna elements in a pattern on said surface such that first selected ones of said antenna elements are responsive to circular polarization and second selected ones of said antenna elements are responsive to linear polarization.

13. The method of claim 12 further including:

passing circularly polarized electromagnetic signals received by the antenna elements to a first output thereof; and passing linearly polarized electromagnetic signals received by the antenna elements to a second output thereof.

14. The method of claim 12 wherein the first and second selected ones of said antenna elements each comprise pairs of antenna elements.

15. The method of claim 12 wherein each antenna element is a wire antenna element with an antenna stub commonly connected to a feed point.

16. The method of claim 12 wherein right handed circularly polarized electromagnetic signals received by the antenna elements are passed to one output thereof and wherein left handed circularly polarized electromagnetic signals received by the antenna elements are passed to another output thereof.

17. The method of claim 12 wherein the antenna elements of the plurality of antenna elements are substantially identical to each other.

18. The method of claim 12 wherein the high impedance surface is disposed in essentially a horizontal orientation and wherein the linear polarization is vertical polarization.

19. A antenna for receiving circularly polarized signals from a position relatively high in the sky and at the same time linearly polarized signals from a position relatively lower in the sky and closer to the horizon, the antenna comprising:

a high impedance surface; and a plurality of antenna elements disposed on said high impedance surface and arranged in a pattern on said surface, first selected ones of said antenna elements being responsive to circular polarization and second selected ones of said antenna elements being responsive to linear polarization.

20. The antenna of claim 19 further including:

an antenna element coupling arrangement coupled to said antenna elements for passing circularly polarized electromagnetic signals received by the antenna system to a first output thereof and for passing linearly polarized electromagnetic signals received by the antenna system to a second output thereof.

21. The antenna of claim 19 wherein the first and second selected ones of said antenna elements each comprise pairs of antenna elements.

22. The antenna of claim 19 wherein each antenna element is a wire antenna element with an antenna stub commonly connected to a feed point.

23. The method of claim 19 wherein the antenna coupling arrangement passes right handed circularly polarized electromagnetic signals received by the antenna system to said first output thereof and passes left handed circularly polarized electromagnetic signals received by the antenna system to a third output thereof.

24. The method of claim 19 wherein the antenna elements of the plurality of antenna elements are substantially identical to each other and the pattern in which they are disposed on said surface is a regular repeating pattern.

25. The method of claim 19 wherein the high impedance surface is disposed in essentially a horizontal orientation and wherein the linear polarization is vertical polarization.

26. An antenna system for receiving both circularly polarized electromagnetic signals and linearly polarized electromagnetic signals, the circularly polarized signals arriving at the antenna system from a direction normal or oblique to a major surface of the antenna system and the linearly polarized signals arriving at the planar antenna system from a direction acute to said major surface, the antenna system comprising:

a high impedance surface which has a surface wave band gap extending over frequencies of (i) the circularly polarized signals and (ii) the linearly polarized signals; and a plurality of antenna elements disposed on said high impedance surface, the plurality of antenna elements arranged in a pattern on said surface such that selected pairs of said antenna elements occur either (i) on one half of one side of said surface or (ii) in a linear relationship on one side of said surface.

27. The antenna system of claim 26 further including an antenna coupling arrangement coupled to said antenna elements for passing circularly polarized electromagnetic signals received by the antenna system to a first output thereof and for passing linearly polarized electromagnetic signals received by the antenna system to a second output thereof.

28. The antenna system of claim 27 wherein the antenna coupling arrangement passes right handed circularly polarized electromagnetic signals received by the antenna system to said first output thereof and passes left handed circularly polarized electromagnetic signals received by the antenna system to a third output thereof.

29. The antenna system of claim 26 wherein the antenna elements of the plurality of antenna elements are substantially identical to each other.

30. A method of receiving circularly polarized signals from a position relatively high in the sky and at the same time linearly polarized signals from a position relatively lower in the sky and closer to the horizon, the method comprising the steps of:

(a) providing a high impedance surface which has a surface wave band gap extending over frequencies of (i) the circularly polarized signals and (ii) the linearly polarized signals; and (b) arranging a plurality of antenna elements in a pattern on said high impedance surface such that first selected ones of said antenna elements are responsive to circular polarization and second selected ones of said antenna elements are responsive to linear polarization.

31. The method of claim 30 wherein the frequencies of (i) the circularly polarized signals and (ii) the linearly polarized signals fall with an upper half of the surface wave band gap of the high impedance surface and wherein the high impedance surface has a size which is equal to or less than one square wavelength of frequencies of the linearly polarized signals.

32. The method of claim 31 further including:

passing circularly polarized electromagnetic signals received by the antenna elements to a first output thereof; and passing linearly polarized electromagnetic signals received by the antenna elements to a second output thereof.

33. The method of claim 31 wherein the first and second selected ones of said antenna elements each comprise pairs of antenna elements.

34. The method of claim 31 wherein each antenna element is a wire antenna element with an antenna stub commonly connected to a feed point.

35. The method of claim 31 wherein right handed circularly polarized electromagnetic signals received by the antenna elements are passed to one output thereof and wherein left handed circularly polarized electromagnetic signals received by the antenna elements are passed to another output thereof.

36. The method of claim 31 wherein the antenna elements of the plurality of antenna elements are substantially identical to each other.

37. The method of claim 31 wherein the high impedance surface is disposed in essentially a horizontal orientation and wherein the linear polarization is vertical polarization.

* * * * *